US007378621B2

(12) United States Patent
Johansson

(10) Patent No.: US 7,378,621 B2
(45) Date of Patent: May 27, 2008

(54) MOLYBDENUM SILICIDE TYPE ELEMENT

(75) Inventor: Lars Göran Johansson, Hallstahammar (SE)

(73) Assignee: Sandvik Intellectual Property AB, Sandviken (SE)

( * ) Notice: Subject to any disclaimer, the term of this patent is extended or adjusted under 35 U.S.C. 154(b) by 480 days.

(21) Appl. No.: 10/504,672

(22) PCT Filed: Feb. 20, 2003

(86) PCT No.: PCT/SE03/00278

§ 371 (c)(1),
(2), (4) Date: Apr. 11, 2005

(87) PCT Pub. No.: WO03/073792

PCT Pub. Date: Sep. 4, 2003

(65) Prior Publication Data

US 2005/0184057 A1 Aug. 25, 2005

(30) Foreign Application Priority Data

Feb. 27, 2002 (SE) ..... 0200587

(51) Int. Cl.
*H05B 3/08* (2006.01)
*H05B 3/14* (2006.01)

(52) U.S. Cl. ..... 219/541; 219/211; 219/212; 219/528; 219/529; 219/552; 219/553; 219/270; 219/402; 338/283; 338/333; 338/334; 338/330; 373/133; 373/134

(58) Field of Classification Search ..... 219/541, 219/211–212, 528–529, 552–553, 270, 402; 373/133–134; 338/283, 333–334, 330
See application file for complete search history.

(56) References Cited

U.S. PATENT DOCUMENTS

| | | | | |
|---|---|---|---|---|
| 3,269,806 A | | 8/1966 | Fitzer et al. | 338/333 |
| 3,373,239 A | * | 3/1968 | Rubisch | 373/128 |
| 4,267,435 A | | 5/1981 | Best | 219/552 |
| 4,720,624 A | | 1/1988 | Kikuchi et al. | 219/553 |

FOREIGN PATENT DOCUMENTS

| | | | |
|---|---|---|---|
| GB | 834739 A | | 5/1960 |
| GB | 2332844 | * | 6/1999 |
| GB | 2332844 A | | 6/1999 |

* cited by examiner

*Primary Examiner*—Shawntina Fuqua
(74) *Attorney, Agent, or Firm*—Alfred J. Mangels

(57) ABSTRACT

The present invention relates to an electrical resistance element of the molybdenum silicide type that includes two terminals (1, 2) for the supply of electric current and at least one leg (3) which extends between the terminals and which includes a glow zone. The invention is characterized in that the glow zone has different diameters along different sections (6-11, 14-17) of the leg (3; 4, 5).

8 Claims, 4 Drawing Sheets

MOLYBDENUM SILICIDE TYPE ELEMENT

BACKGROUND OF THE INVENTION

1. Field of the Invention

The present invention relates to an electrical resistance element of the molybdenum silicide type.

2. Description of the Related Art

Such elements have long been known in different forms with regard to their different alloy contents. Kanthal AB of Sweden are manufacturers of such elements. These types of elements are referred to as molybdenum silicide-type elements, which have long been used to heat ovens and different kinds of surfaces, such as a radiating surface that radiates onto an object, or cooker plates, or other surfaces.

Molybdenum silicide elements are produced in different forms. A typical form is a so-called leg element, which comprises two legs that extend between two electrical conductors or terminals at one of their ends. The legs are joined with an arcuate or curved part at their other ends. The leg elements can consist of one, two, or more legs. Two-legged elements, or multi-leg elements, include one or more curved parts that extend between the conductors. The leg constitutes a glow zone, i.e., that part of the element that glows when supplied with electric current, and therewith delivers heat to an object.

One problem experienced with industrial furnaces, ovens, and the like resides in the difficulty at times of maintaining a sufficiently uniform temperature distribution in a furnace space, or in achieving sufficiently uniform thermal radiation from a radiating surface. An uneven temperature distribution or uneven radiation will mean that the space or the object to be heated will not be heated uniformly, which can be highly problematic.

A concrete example is when liquid-metal ladles are to be pre-heated. Uneven heating of a ladle presents a problem when using resistance elements, as the bottom of the ladle will not be as hot as the inner walls of the ladle.

The known method of attempting to resolve this problem involves the installation of a number of elements or groups of elements that can be controlled individually, so that different elements have delivered power of different high magnitudes.

The present invention solves the problem caused by uneven heating.

SUMMARY OF THE INVENTION

Accordingly, the present invention relates to an electrical resistance element of the molybdenum silicide type that includes two terminals for the supply of electric current. At least one connecting member extends between the terminals and includes a glow zone. The glow zone has different diameters along different connecting member sections.

BRIEF DESCRIPTION OF THE DRAWINGS

The invention will now be described in more detail, partly with reference to the embodiments of the invention shown in the accompanying drawings, in which.

DESCRIPTION OF THE PREFERRED EMBODIMENTS

Figure 1:
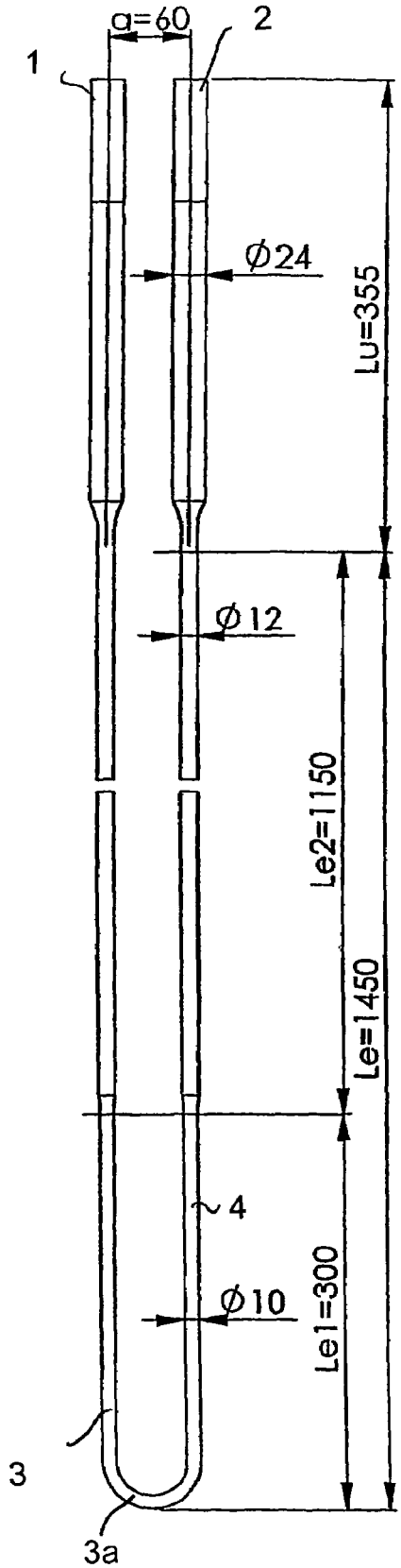
FIGS. 1, 2, and 3 show different forms of two-legged heating elements.

The respective relative measurements of certain parts of the elements have been shown in the drawings for the sake of clarity. It will be understood, however, that these measurements have been given only by way of example. In the Figures, reference character Lu indicates the length of the terminals and reference character Le indicates the length of the glow zone. Reference characters Le1, Le2, and Le3 indicate the lengths of different sections of the glow zone of the element, and reference character "a" indicates a distance.

According to one embodiment, an electric resistance element of the present type includes two electricity supply terminals 1, 2, and two legs 3, 4, which extend between the terminals and which include a glow zone.

According to the present invention, the glow zone has different diameters along different sections of the legs.

This means that the heat developed will differ in magnitude along different sections of the element, due to the disparity in the amperage or current intensity in each applicable cross-sectional area of the element. The invention thus allows an element to be designed in accordance with the heating requirements that exist along the full extent of the element.

An inventive element of the kind illustrated in FIG. 1 can be used in the case of the above example concerning a ladle whose bottom is not heated sufficiently in relation to the inner walls of the ladle when using a known element. The inventive element has terminals having a diameter of 24 millimeters, and two legs 3, 4 whose upper parts are 12 millimeters in diameter and lower parts which are 10 millimeters in diameter. Such an element will become hotter at its narrower, lower, part. This higher temperature will make that part of the object located close to this section of the ladle much hotter.

According to one embodiment of the invention, the element has two legs with only one curved part 3*a* between the terminals 1, 2; see FIG. 1.

Figure 4:
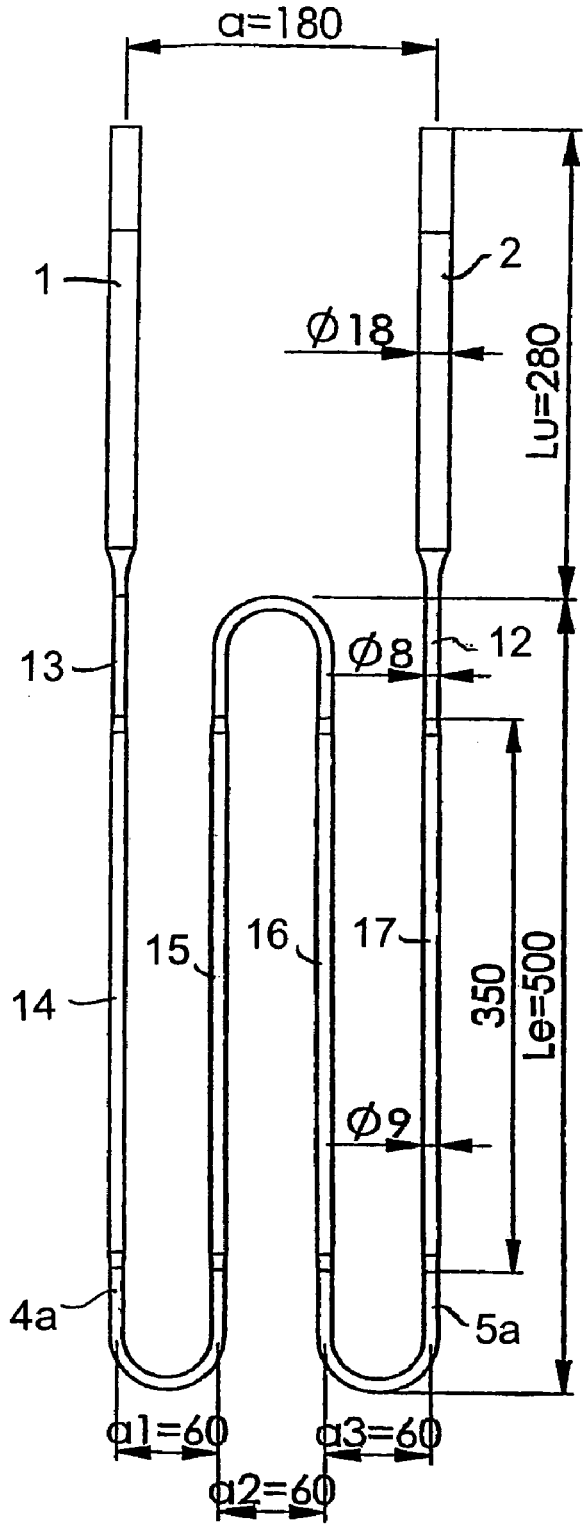
FIG. 4 shows a four-legged heating element.

According to another embodiment of the invention, the element has four legs, see FIG. 4, or more, and includes two curved parts 4*a*, 5*a*, or more, between the terminals 1, 2.

An element of the present kind may also be formed with only one leg, for example a straight leg that has a terminal at each end.

Figure 2:
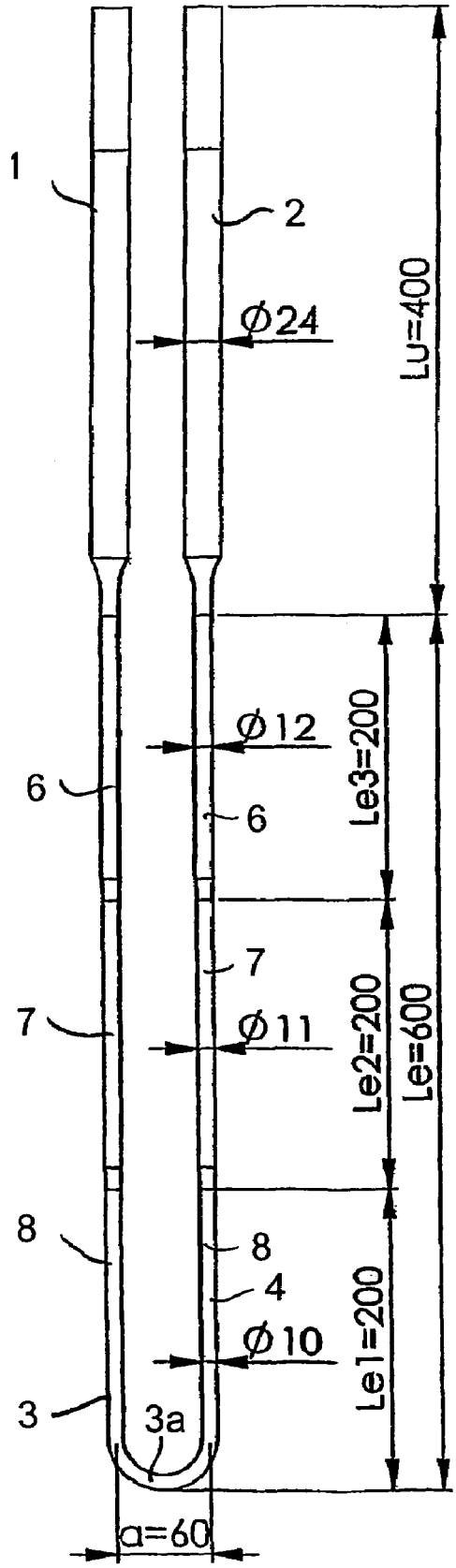

FIG. 2 illustrates an embodiment in which the glow zones have mutually different diameters along different sections 6, 7, 8 of the legs, where the diameters of respective sections become smaller with increasing distance of the respective sections 6, 7, 8 from the terminals 1, 2.

Figure 3:
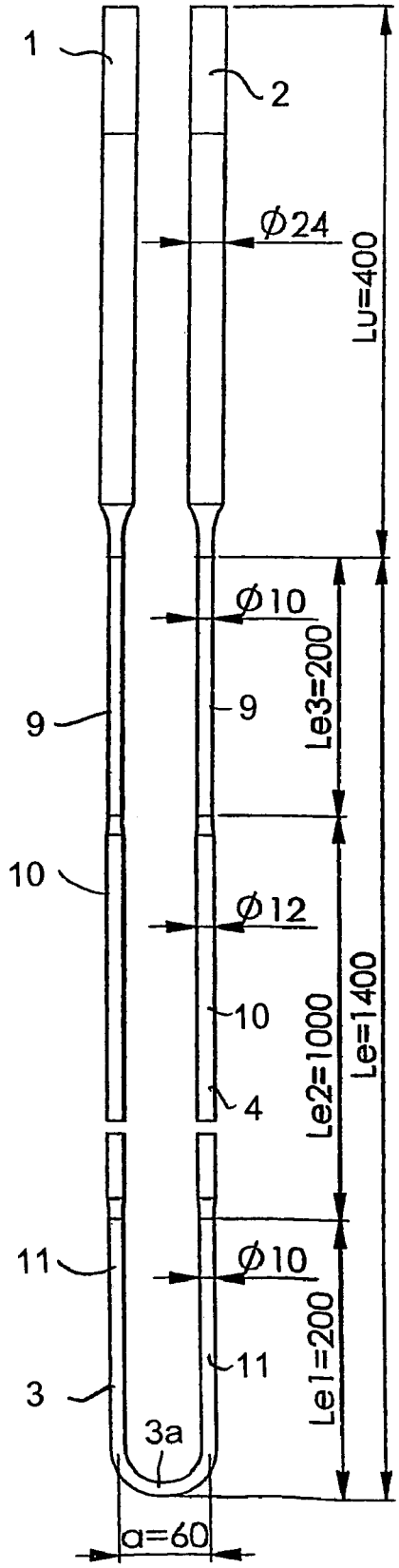

FIG. 3 illustrates an embodiment in which the glow zone has mutually different diameters along different sections 9, 10, 11 of the legs 3, 4, where the diameters of the sections decrease and increase along the legs. The same design can, of course, be utilized in elements that have two or more legs. In the FIG. 3 embodiment, the sections 9 and 11 have a diameter of 10 millimeters and the section 10 has a diameter of 12 millimeters.

In the case of certain applications, the glow zone will preferably have different diameters along different leg sections, wherein the diameters of respective sections are smaller the closer the sections are to the terminals. In the FIG. 4 embodiment, the sections 12, 13 have a diameter of 8 millimeters, while the sections 14-17 have a diameter of 9 millimeters.

Although only elements that lie in a single plane are shown in the Figures, it will be understood that an element may include two or more legs, where one, two, or more legs, or parts thereof, define an angle with a plane in which the terminals lie.

The elements may be designed to heat a volume in a known manner, or to form a radiating surface. Moreover, the elements may be designed, and possibly supported, for mounting vertically, horizontally, or at another angle to the horizontal plane.

The different embodiments illustrated in the drawings are, of course, exemplifying embodiments with regard to shape and diameters. As will be obvious to those skilled in this art, elements can be given generally any shape and form, with mutually different diameters that provide the heating effect desired for a particular application. The present invention is therefore not limited to any particular element design, as long as different sections have different diameters.

The present invention shall not therefore be considered to be restricted to the described and illustrated embodiments, since variations and modifications can be made within the scope of the accompanying claims.

What is claimed is:

1. An electrical resistance element of the molybdenum silicide type for heating to a high temperature, said element comprising: two terminals for the supply of electric current, and at least one leg formed from a molybdenum silicide-type material which extends between the terminals and which includes a glow zone, wherein the glow zone has a plurality of heating regions each of predetermined length and having different diameters along different heating regions of the at least one leg, wherein each heating region of the glow zone is of constant cross-sectional area.

2. A resistance element according to claim 1, wherein the element has two legs and only one curved part that extends between the legs.

3. A resistance element according to claim 1, wherein the element has at least three legs and at least two curved parts that extend between respective legs.

4. A resistance element according to claim 1, wherein the element has at least one leg, wherein at least one part of at least one leg defines an angle relative to a plane in which the terminals lie.

5. A resistance element according to claim 1, wherein the diameters of glow zone sections are smaller the further away from the terminals the respective glow zone heating regions are located.

6. A resistance element according to claim 1, wherein the glow zone heating regions include regions having different diameters, wherein the diameters of said heating regions are smaller the nearer said heating regions are to the terminals.

7. A resistance element according to claim 1, wherein the glow zone has different constant diameter heating regions along its length, wherein the heating region diameters alternate in magnitude between larger diameter heating regions and smaller diameter heating regions that each define respective individual heating regions.

8. A resistance element according to claim 1, wherein the element includes a plurality of laterally spaced, interconnected, substantially parallel legs, wherein ends of adjacent legs are interconnected by respective curved regions to define a continuous element between the terminals.

* * * * *